United States Patent [19]

Ehrlich

[11] Patent Number: 5,060,712

[45] Date of Patent: Oct. 29, 1991

[54] TABLE SKIRT-ATTACHING METHOD

[76] Inventor: Paul Ehrlich, 241 Mill St., Lawrence, N.Y. 11559

[21] Appl. No.: 538,704

[22] Filed: Jun. 15, 1990

[51] Int. Cl.[5] ..... A47H 1/00

[52] U.S. Cl. ..... 160/330; 248/205.2

[58] Field of Search ..... 248/205.2, 345.1, 231.8, 248/316.7; 150/52 R; 160/330, 369, 392; 24/457, 563, 570; 108/161, 28, 90

[56] References Cited

U.S. PATENT DOCUMENTS

| | | | |
|---|---|---|---|
| 3,235,926 | 2/1966 | Mates | 160/330 X |
| 3,368,601 | 2/1968 | Merz | 150/52 R |
| 3,777,800 | 12/1973 | Susoev | 160/330 X |
| 3,905,414 | 9/1975 | Guebert | 160/330 |
| 3,959,854 | 6/1976 | Lewis | 24/457 |
| 4,153,097 | 5/1979 | Pettibone | 160/330 |
| 4,213,492 | 7/1980 | Guebert | 160/330 X |
| 4,237,958 | 12/1980 | Guebert | 160/330 |
| 4,708,183 | 11/1987 | Figueroa | 150/52 R |

*Primary Examiner*—J. Franklin Foss

[57] ABSTRACT

For attaching a decorative skirt from an edge of a banquet table to mask the legs or otherwise enhance the appearance thereof, the addition to clips which are clipped to the table edge of a first velcro strip which engages a second velcro strip on the skirt, the first velcro strip also preventing, because the clips are attached to it, the inadvertent misplacement of the clips when the skirt is removed for cleaning or the like.

1 Claim, 1 Drawing Sheet

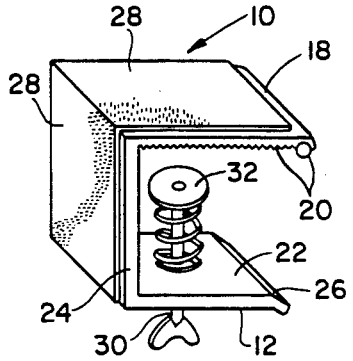
FIG.1
PRIOR ART
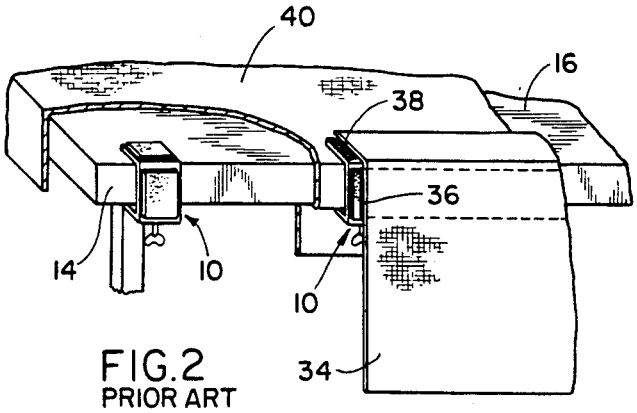
FIG.2
PRIOR ART
FIG.3
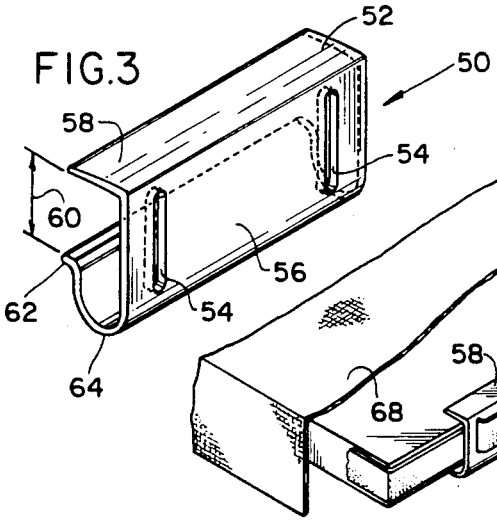
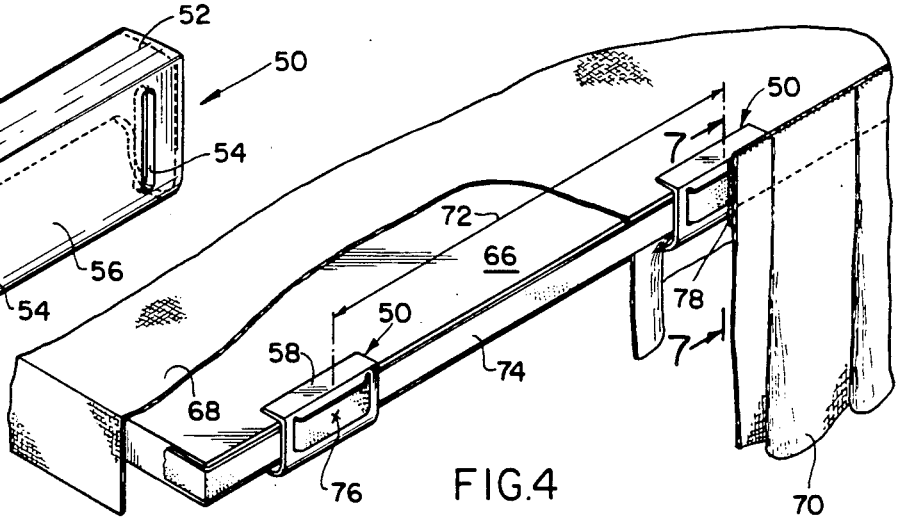
FIG.4
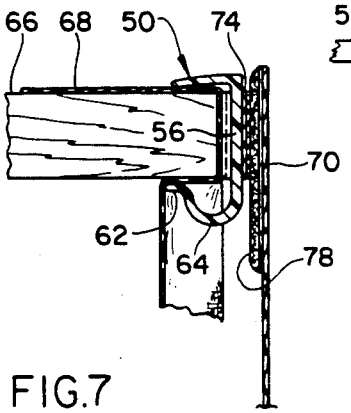
FIG.7
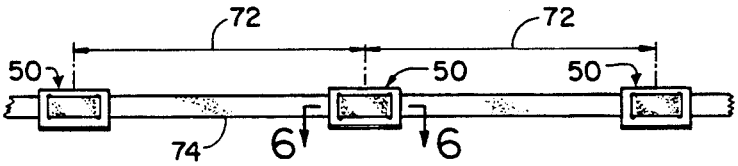
FIG.5
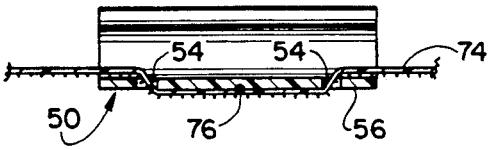
FIG.6

TABLE SKIRT-ATTACHING METHOD

The present invention relates generally to applying a decorative skirt to a banquet or similar table to mask the legs thereof as well as enhance its appearance with the color, pleats or other features of the attached skirt, and more particularly to improvements in the use of table-attaching clips and velcro strips in achieving the suspension of the skirt about the peripheral edge of the table.

EXAMPLE OF THE PRIOR ART

It is already well known, as exemplified by U.S. Pat. No. 4,708,183 issued on Nov. 24, 1987 to Figueroa, that interengaging velcro patches and strips are an effective means of removably attaching a decorative skirt to a table. In Figueroa, plastic clips with velcro patches are strategically located about the table edge and a velcro strip sewn or otherwise secured along the top of the decorative skirt is engaged to the patches on the previously positioned clips to complete the application of the skirt to the table.

The prior art above noted clips do not always remain attached to the table edge after the skirt is removed for cleaning or the like, and thus often are misplaced. And, if applied with sufficient gripping pressure to avoid shifting in position and to remain attached to the table, the clips might mar the surface of the table.

Generally, it is an object of the present invention to provide a table skirt-attaching method overcoming the foregoing and other shortcomings of the prior art. Specifically, it is an object to use a velcro strip, that is used to complete the attachment of the skirt to the table, also as a component for receiving in attached relation thereto the table engaging clips, so that these otherwise unattached clips are not subject to being misplaced, and in other respects providing noteworthy benefits in the skirt attaching process.

The description of the invention which follows, together with the accompanying drawings should not be construed as limiting the invention to the example shown and described, because those skilled in the art to which this invention appertains will be able to devise other forms thereof within the ambit of the appended claims.

In preparing a smorgasbord table typically used at a wedding, banquet or like social function, use is made of attaching clips and velcro to suspend a decorative skirt about the table, one such attaching clip exemplifying the prior art being shown in FIG. 1 in a perspective view;

FIG. 2 is similarly a perspective view showing, more particularly, the clip of FIG. 1 in its intended use;

The remaining figures illustrate an improved method according to the present invention of suspending a decorative skirt about a table wherein FIG. 3 is a detail perspective view of the clip component of the present invention;

FIG. 4 is a perspective view illustrating the inventive use of the clip of FIG. 3;

FIG. 5 is a front elevation view projected from FIG. 4;

FIG. 6 is a cross sectional view as taken along line 6—6 of FIG. 5; and FIG. 7 is a cross sectional view as taken along line 7—7 of FIG. 4.

To better understand the patentable advance of the within table skirt attaching method, it is helpful to compare it to the prior art method illustrated in FIGS. 1 and 2. More particularly shown in these figures is a prior art retainer device or plastic clip 10 having a generally C-shaped body 12 by which it is adapted to clamp on the edge 14 of a banquet or similar table top 16. Body 12 has an upper horizontally oriented leg 18 with gripping ridges 20 on its undersurface, and is connected to a lower horizontally oriented bottom leg 22 with a slip-over edge 26 wall 24. The exterior surfaces of the leg 18 and connecting wall 24 have adhesively attached patches 28 of Velcro hook material. Centrally disposed on leg 22 is a spring biased pin 30 which presses a washer 32 against the underside of table top 16 when clip 10 is in use.

In FIG. 2 demonstrating the use of the clips 10, they are shown clamped to an uncovered table top 16. A table-decorating skirt 34, with strips 36 and 38 of Velcro loop material stitched or adhesively secured thereon, is typically in turn secured directly to Velcro hook patches 28 on the spaced apart clips 10 located along table edge 14 when a table cover 40 is not used. When a cover 40 is used, a sufficient number of clips 10 are used to clip the cover 40 to table top 16, and the skirt 34 is added as shown in FIG. 2.

The present art clips 10- may inadvertently mar the table 14 at the pressure locations of the washers 32 and, a more significant shortcoming is that the clips 10 often are misplaced because they readily detach from the table. To obviate the foregoing and other shortcomings, the within table skirt support system, shown in FIGS. 3–7, uses a subassembly of a first velcro strip and plastic clips attached thereto, and in practice it has been found that such a subassembly minimizes clip loss because there is, of course, no unattached clips. The clips referred to are identically constructed to clip 50 of FIG. 3 which, in a preferred embodiment, will be understood to be manufactured as a clear or colored plastic extrusion 52 that has a J-shaped cross section. Extrusion 52 is first cut to a preferred length and then machined to have a pair of vertical slots 54 in a vertical wall 56 adjacent each end. An upper flat leg 58 extends rearwardly and is angled slightly downwards and is spaced a distance 60 above a parallel lower lip or edge 62. Lip 62 is at the outer edge of a lower curved configuration of the J cross-section of extrusion 52. In a well understood manner the curvature serves as a spring which cooperates with leg 58 to secure clip 50 to a table top 66 whose thickness is slightly more than the distance 60. Clips 50 are manufactured in various sizes, to have an appropriately sized opening 60 in conformity with industry standards for table tops having thicknesses of $\frac{5}{8}$", $\frac{3}{4}$" and 1".

Clips 50 are used to support a skirt 70, with or without a table cover 68, by being threaded, in a select number and predetermined spacing 72, along a first strip of Velcro hook material 74. As best seen in FIG. 6, strip 74 is interwoven through slots 54 in wall 56 of each clip 50, with the "hook" side facing outwardly or away from the opening 60. To obviate their loss, each of the clips 50 are fastened to strip 74 by stapling, or other appropriate manner, as at point 76. It is contemplated the user will then attach, using the clips 50; velcro strip 74 to the edge of the table 66 so that strip 74 is taut and provided with an operative position in which it is facing outwardly therefrom and extends entirely about the periphery of the table 66. The ends of strip 74 are advantageously clipped to the table 66 to maintain the taut condition thereof.

Skirt 70 is prepared with a second strip of velcro loop material 78 fastened by stitching or adhesive attachment along its upper edge. After clips 50 have been spaced along the periphery of table 66, the user readily applies skirt 70 using loop material 78 thereon by interengaging the two strips 75 and 78.

From the foregoing description, it should be readily appreciated that the present invention provides a dependable, convenient, quickly assembled, table skirt support system in which, in contrast to presently used prior art systems, the attachment of the clips to the velcro strip which the clips position for attachment to the skirt velcro strip also serves as both a means to stabilize the clips against shifting in position and obviating unattached and thus readily misplaced clips, and also providing an increased amount of interengaging velcro, since there is more velcro in the strip between clips than that which covers the prior art clips.

While the particular table skirt attaching method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A method of attaching a skirt for decorating a table in depending relation about the peripheral edge of said table using velcro strips and resilient table edge-engaging clips, said method comprising the steps of threading a selected number of said table edge-engaging clips in spaced relation along a first velcro strip, stapling each edge-engaging clip in its position located along said first velcro strip only to said velcro strip, to both establish said positions thereof along said velcro strip and minimize the misplacement of otherwise unattached edge-engaging clips, establishing by the engagement of said spaced clips to said peripheral edge of said table an operative position for said first velcro strip that is facing outwardly therefrom and extending about the periphery of said table, attaching a second velcro strip along an upper edge of a decorative skirt for said table, and attaching said first and second velcro strips to each other, to thereby correspondingly attach said skirt in suspended relation about said table.

* * * * *